US006056121A

United States Patent [19]

Olson

[11] Patent Number: 6,056,121

[45] Date of Patent: May 2, 2000

[54] SHIPPING CONTAINER FOR MODULAR CHAIRS

[75] Inventor: Lisa M. Olson, Tecumseh, Mich.

[73] Assignee: La-Z-Boy Incorporated, Monroe, Mich.

[21] Appl. No.: 08/988,614

[22] Filed: Dec. 11, 1997

[51] Int. Cl.[7] ..... B65D 5/50

[52] U.S. Cl. ..... 206/577; 206/326; 206/499

[58] Field of Search ..... 206/320, 326, 206/499, 576, 577, 521, 591

[56] References Cited

U.S. PATENT DOCUMENTS

| | | | |
|---|---|---|---|
| 1,504,292 | 8/1924 | Wickes | 206/320 |
| 1,900,820 | 3/1933 | Kenyon et al. . | |
| 2,418,731 | 4/1947 | Seitz . | |
| 2,660,228 | 11/1953 | Reinhold . | |
| 3,008,572 | 11/1961 | Wagner | 206/499 |
| 3,771,646 | 11/1973 | Mascetti, Jr. | 206/499 |
| 3,927,767 | 12/1975 | Sato et al. . | |
| 3,992,849 | 11/1976 | Lett, III . | |
| 4,117,929 | 10/1978 | VanderMey . | |
| 4,170,297 | 10/1979 | Johnson | 206/499 |
| 4,254,866 | 3/1981 | Fales et al. . | |
| 4,640,419 | 2/1987 | Yang | 206/499 |
| 5,178,279 | 1/1993 | Carroll . | |
| 5,263,582 | 11/1993 | Schaaf . | |
| 5,301,491 | 4/1994 | Boardman, Jr. et al. . | |
| 5,540,972 | 7/1996 | Jaegers et al. | 428/116 |
| 5,779,045 | 7/1998 | Yu | 206/320 |

OTHER PUBLICATIONS

Hexacomb brochure "Hexacomb Packaging Products", copyright 1994.

*Primary Examiner*—Jim Foster
*Attorney, Agent, or Firm*—Harness, Dickey & Pierce, P.L.C.

[57] ABSTRACT

An interlocking pallet assembly for containing an arrangement of components within a shipping container is disclosed. The shipping container includes a first pallet having a plurality of compartments for containing a plurality of components, at least one of the components including a vertical member which extends above the surface of the first pallet, and a second pallet having a plurality of compartments for containing a plurality of components, and at least one aperture for receiving the vertical member associated with the first pallet through a bottom portion thereof. The first and second pallets are similarly dimensioned so that when the second pallet is disposed on the first pallet, the vertical member aligns with and engages the aperture formed in the second pallet thereby forming an interlocking mechanism for preventing movement of the second pallet relative to the first pallet.

20 Claims, 4 Drawing Sheets

FIG 3
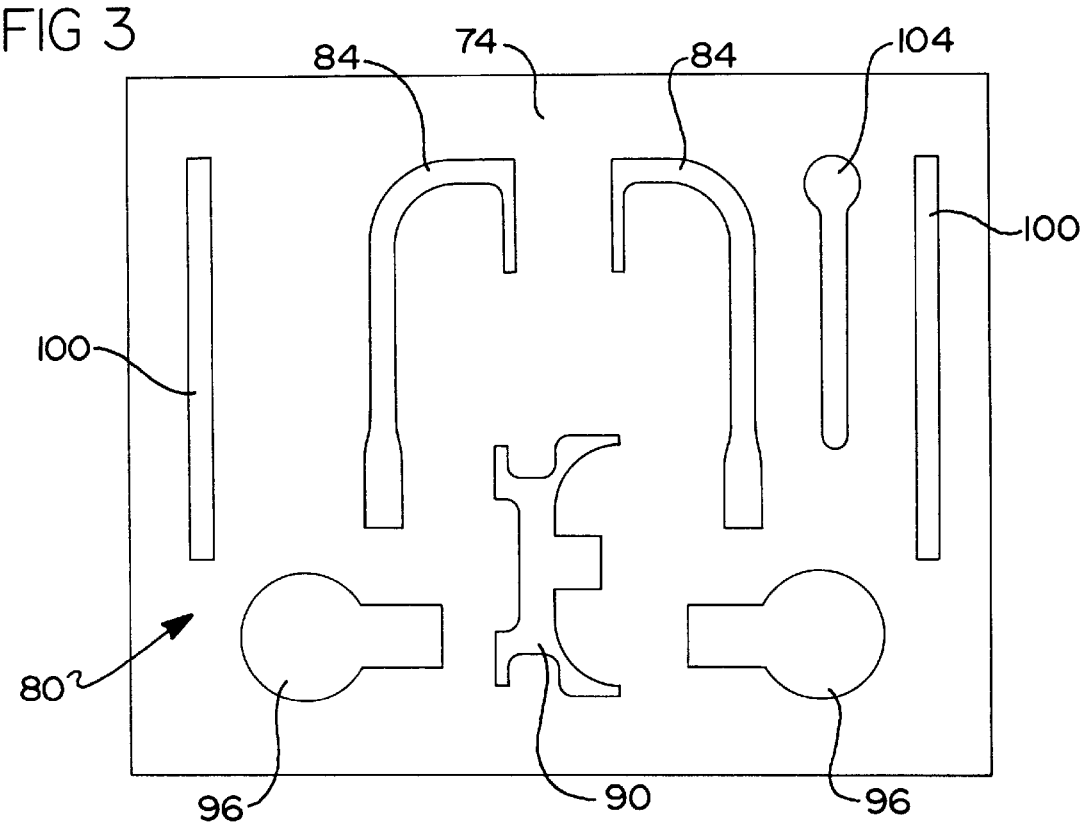
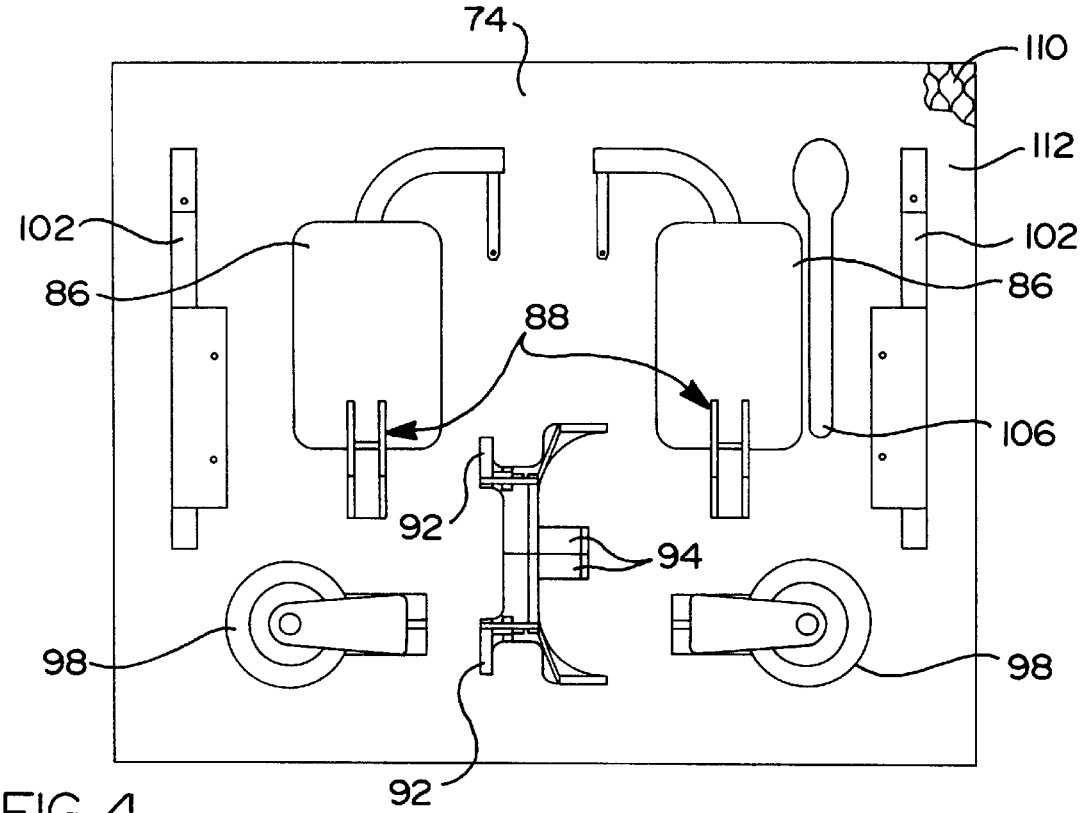
FIG 4

FIG 5
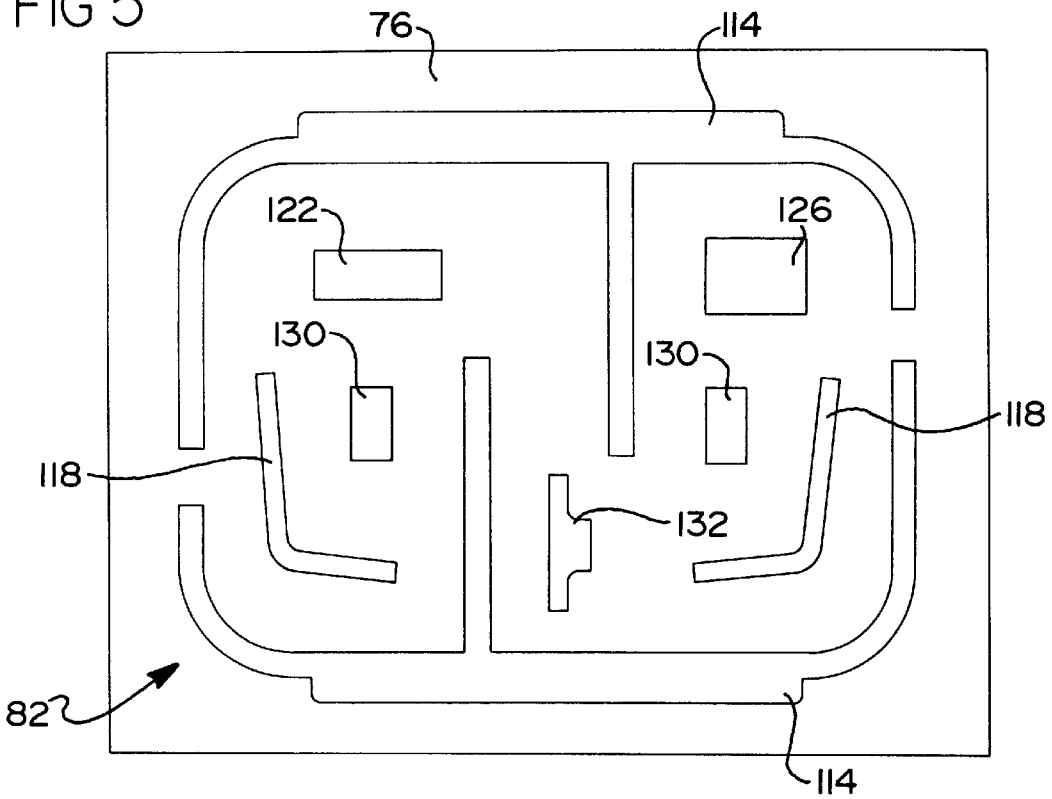
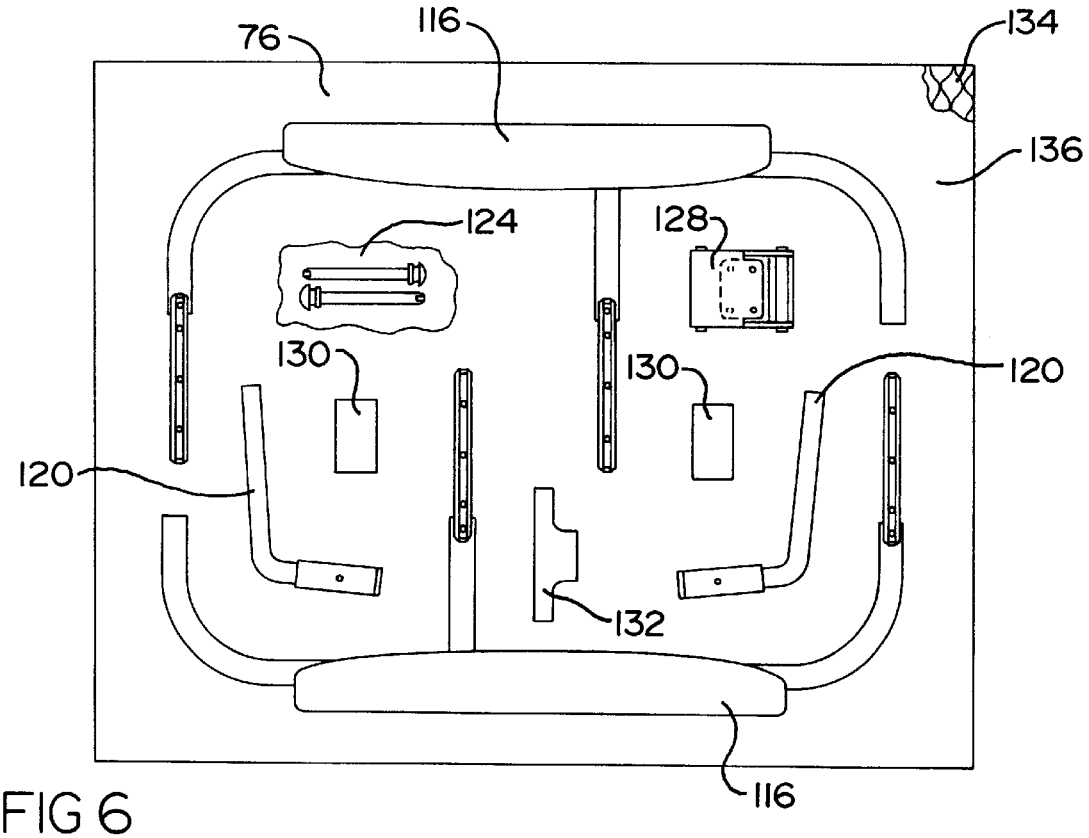
FIG 6

SHIPPING CONTAINER FOR MODULAR CHAIRS

BACKGROUND OF THE INVENTION

1. Technical Field

The present invention relates generally to a shipping container for furniture. More specifically, the present invention relates to an apparatus for shipping the partially assembled components of a modular wheeled health care chair.

2. Discussion

In an attempt to manage ever increasing health care costs, more and more individuals are electing to be provided with health care services within their own home. As such, there is a growing need for medical devices and health care products which can be used in a residential environment, and efficient channels for delivering these devices. However, there appears to be a limited number of channels through which these home health care products are currently made available to consumers. An additional problem is that the relatively few number of retail establishments which provide suitable home health care products cannot be easily accessed by disabled individuals who have difficulty traveling outside their home. One such example is a disabled individual who can only be transported in a wheel chair.

Wheeled chairs are widely used in a variety of both residential and commercial health care applications, and as such, are adapted to mobilize the seat occupant under a wide range of conditions. Most of the wheel chairs known in the prior art are designed toward the mobility of the seat occupant, and less toward the functionality and comfort of the seat occupant. At present, wheeled chairs for specialized purposes are typically only available through specialty medical products channels and are usually quite expensive. Moreover, the prior art wheel chairs which incorporate comfort features are generally heavier and cannot be easily transported. The total weight of these chairs, even when disassembled, generally requires that they must be shipped to individuals as freight as with other heavy or bulky furniture products, rather than being shipped as a parcel or package through commercial parcel delivery services. The cost associated with shipping a suitable wheel chair as freight is typically higher than the cost of shipping a suitable wheel chair as a parcel. Moreover, shipping the chair as freight takes considerably more time. A further problem is that many parcel delivery services set limitations for the total weight of a parcel, as well as the external dimensions of the shipping carton for containing the parcel. Thus, the wheel chairs known within the art which provide a suitable level of comfort features are either too heavy, or if modular, are not packaged within a suitable container which is acceptable to commercial parcel delivery services. As such, these wheel chairs must be shipped with a freight carrier at a higher cost to the consumer and a longer time for delivery.

In view of the problems associated with prior art wheel chairs, it is desirable to provide a shipping apparatus and container system for shipping the partially assembled components of a modular wheel chair. One such approach is to provide a modular wheel chair which can be easily assembled and disassembled using a limited number of simple hand operated tools. It is further desirable to provide a shipping container which is lightweight and compactly dimensioned so that the shipping container or containers can be handled by lower cost parcel delivery services as opposed to higher cost freight carriers. Finally, it is desirable to provide a shipping apparatus having a system of interlocking pallets for containing the partially assembled components and providing suitable protection to these components during shipping. The combination of such a modular wheel chair and lightweight shipping container would significantly increase the availability of wheeled health care chairs to disabled individuals within their own homes. Moreover, a lightweight shipping container would further allow the shipping of partially assembled wheel chairs on an expedited or overnight basis.

SUMMARY OF THE INVENTION

The present invention relates to an interlocking pallet assembly for containing an arrangement of components within a shipping container. As disclosed, the shipping container includes a first pallet having a plurality of compartments for containing a plurality of components, at least one of the components including a vertical member which extends above the surface of the first pallet. The shipping container also includes a second pallet having a plurality of compartments for containing a plurality of components, and at least one aperture for receiving the vertical member associated with the first pallet through a bottom portion thereof. The first and second pallets are similarly dimensioned so that when the second pallet is disposed on the first pallet, the vertical member aligns with and engages the aperture formed in the second pallet thereby forming an interlocking mechanism for preventing movement of the second pallet relative to the first pallet.

In a related embodiment of the invention, a shipping device for containing a modular wheel chair in a partially assembled fashion is provided. As part of this related embodiment, the shipping device includes a first carton for containing a partially assembled wheel chair base. The first carton also includes a bottom member for supporting the wheel chair base. A pallet member is disposed in the first carton for supporting a wheel assembly for the wheel chair base. The shipping device also includes a second carton for containing a seat back member. The seat back member is operably associated with the wheel chair base. A first compartmentalized pallet is disposed in the second carton for containing at least a foot plate assembly, wherein the foot plate assembly includes a vertical member extending above an upper surface of the first pallet. A second compartmentalized pallet is disposed on the first pallet for containing components associated with the wheel chair base and includes an aperture formed therein. The aperture is positioned for receiving the vertical member of the foot plate assembly through a lower portion thereof and forming an interlocking mechanism thereby preventing movement of the second pallet relative to the first pallet.

BRIEF DESCRIPTION OF THE DRAWINGS

The various advantages of the present invention will become apparent to one skilled in the art by reading the following specification and appended claims, and by referencing the following drawings in which:

FIG. 3 is a plan view of a compartmentalized pallet showing the various cutouts for receiving the partially assembled components of the modular chair;

FIG. 4 is a plan view of the compartmentalized pallet of FIG. 3 showing the modular components contained within their designated compartment;

FIG. 5 is a plan view of a compartmentalized pallet showing the various cutouts also for receiving the partially assembled components of the modular chair; and FIG. 6 is a plan view of the compartmentalized pallet of FIG. 5 shown with the modular components positioned in their designated compartment.

DETAILED DESCRIPTION OF THE PREFERRED EMBODIMENTS

In general, the present invention is directed to a lightweight container for shipping a modular chair. While the following description is directed to a container for shipping the modular components of a partially assembled wheeled health care chair, it will be understood that the present invention is also applicable to a shipping apparatus and container system for shipping a variety of modular articles of furniture and modular chairs which can be shipped in a partially assembled state.

Figure 1:
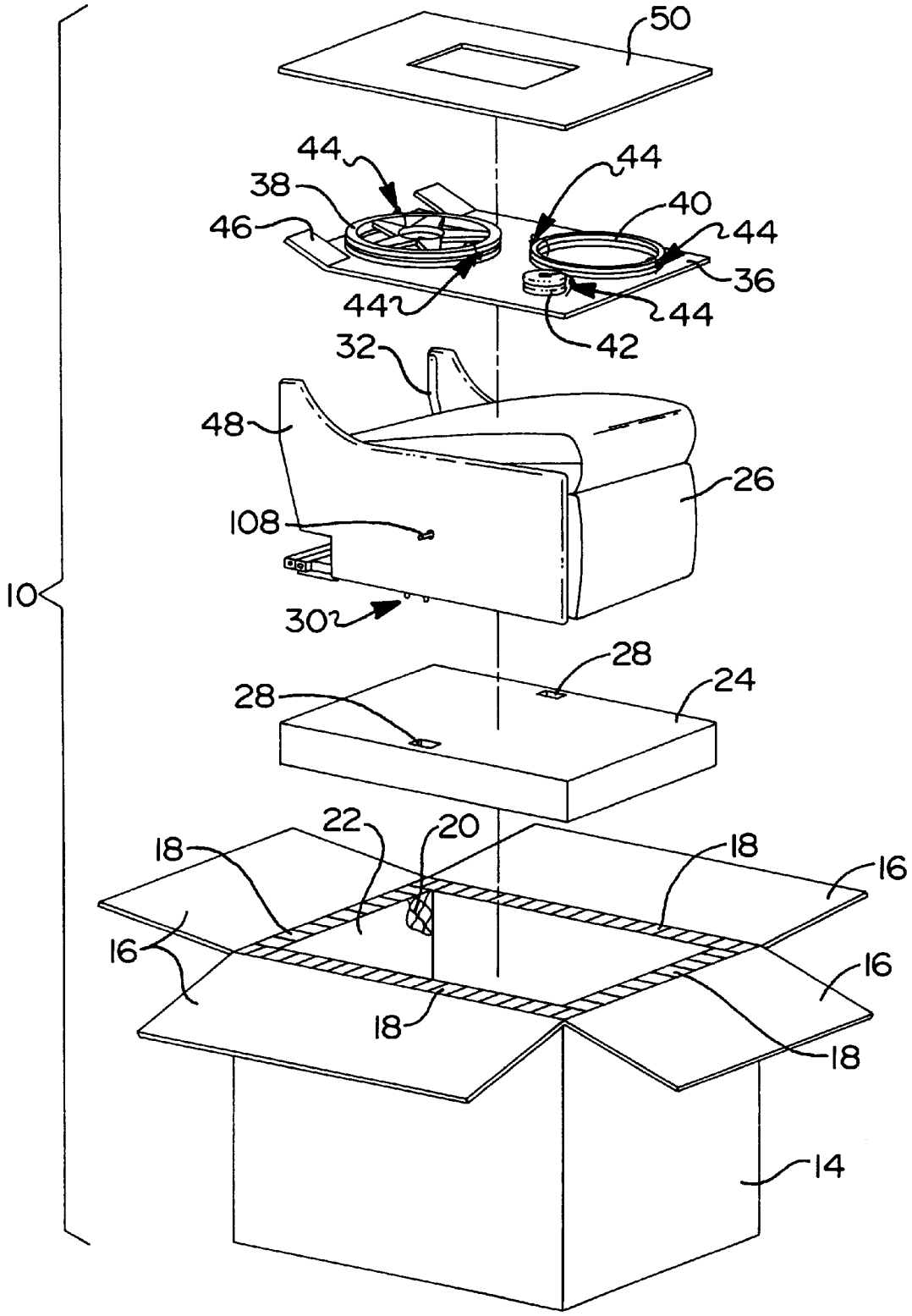
FIG. 1 is an exploded perspective view of the shipping apparatus according to a preferred embodiment of the present invention.

Turning now to FIG. 1, the shipping container 10 according to the preferred embodiment of the present invention is shown. Shipping container 10 is generally defined by a chair base carton 14 preferably formed from corrugated cardboard, or another suitable material. Carton 14 includes four flaps 16 which define an opening at the top portion thereof. The inside side walls of carton 14 are lined with four padding members 18 which provide additional protection to the contents within shipping container 10. Preferably, each padding member 18 is formed from a paper fiber material defining an inner honeycomb structure 20 which is covered by an outer facing layer 22 on both sides thereof. Preferably facing layer 22 is a heavy duty kraft paper, or a similar substitute. A bottom support member 24, which is also manufactured from a honeycomb cardboard structure fits within the bottom of carton 14 which provides the primary protection to the undercarriage of a modular wheel chair base 26. Bottom support member 24 includes a pair of cut-outs 28 for receiving the protruding members 30 which extend from the undercarriage of wheel chair base 26.

Carton 14 and its associated components are specifically designed for the modular wheel chair base 26 disclosed in U.S. Ser. No. 08/892,048, filed Jul. 14, 1997, entitled "Wheeled Health Care Chair," which is commonly owned and the disclosure of which is expressly incorporated herein by reference. Modular wheel chair base 26 also includes an upwardly extending seat back link 32 for receiving the chair's modular seat back 66. A pallet 36 is provided for securing various components of the modular chair. Preferably, pallet 36 is formed from corrugated cardboard. More specifically, a pair of rear wheels 38, a pair of rear wheel hand rings 40, and a pair of hub caps 42 can be secured to pallet 36 using suitable fasteners such as locking cable ties 44 which are fitted around each modular component 38, 40, 42 and through apertures formed in pallet 36 and locked into place. This arrangement securely retains each modular component 38, 40, 42 within carton 14 during shipping. Pallet 36 is dimensioned so that it fits snugly on all four sides within the inside area defined by padding members 18. A pair of flaps 46 are provided to allow pallet 36 to be disposed on top of wheel chair base 26 so that flaps 46 will deflect when applied against the rear upstanding portions 48 of wheel chair base 26. The packaging of shipping container 10 is completed with a top cover 50, also preferably formed from corrugated cardboard for providing protection to the modular components 38, 40, 42 secured on pallet 36.

As will be appreciated, when all of the modular components are packed within carton 14, shipping container 10 defines a durable yet lightweight shipping apparatus for shipping modular wheel chair base 26 and its pre-assembled components. As disclosed, the outside dimensions of carton 14 are approximately 30 inches in length, 29 inches in width, and 21 inches in height, and the weight of shipping container 10 is approximately 89 pounds. Accordingly, these specifications are within the currently accepted standards of many commercial parcel and overnight delivery services.

Figure 2:
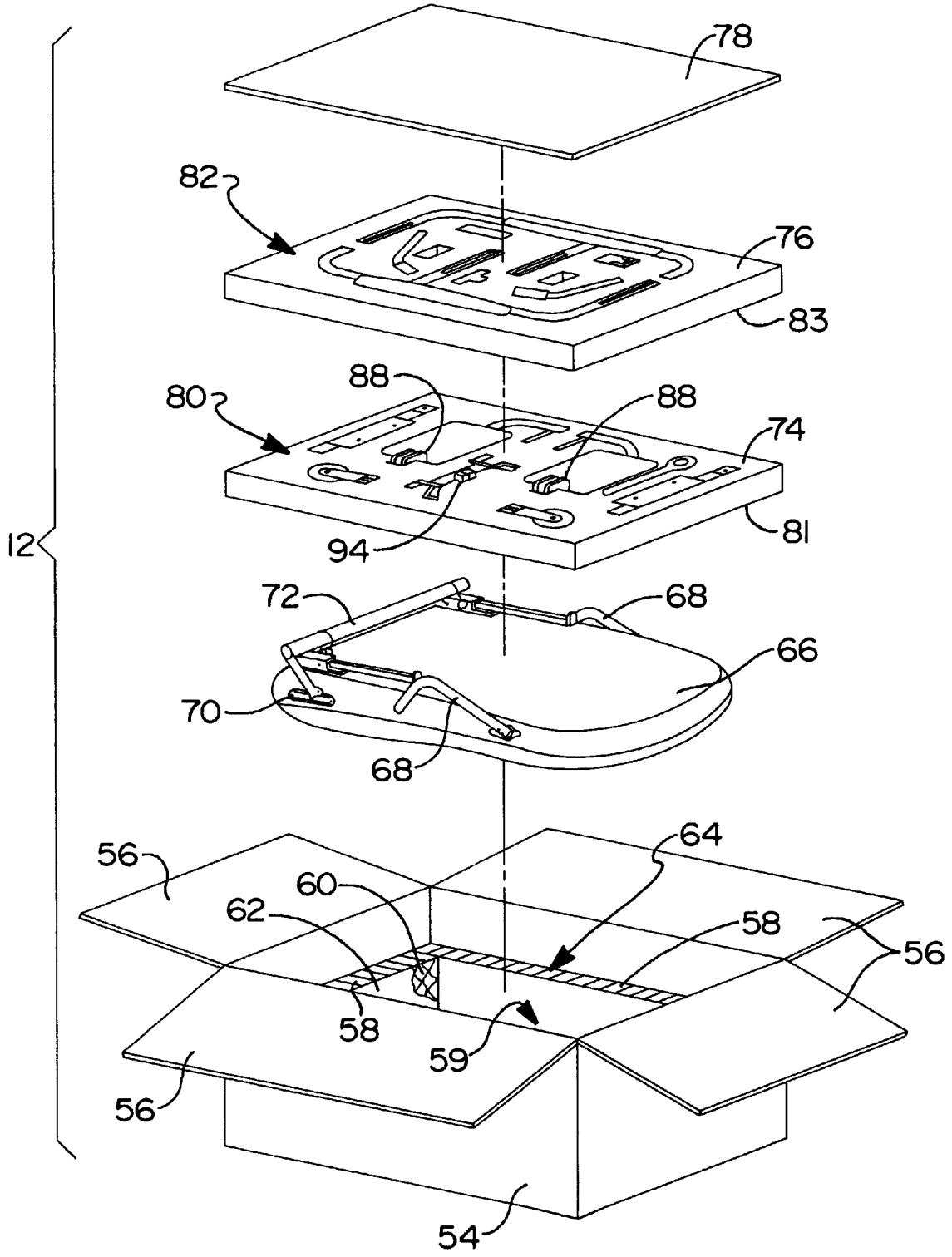
FIG. 2 is an exploded perspective view also showing the shipping apparatus according to the preferred embodiment of the present invention.

Referring now to FIG. 2, shipping container 12 is also disclosed in accordance with the preferred embodiment of the present invention. Shipping container 12 is generally defined by a carton 54 also having four flaps 56 which define the top opening thereof. The inner side walls of carton 54 are lined with four padding members 58 for providing additional protection to the contents of shipping container 12. Each padding member 58 is also formed from a paper fiber honeycomb structure 60 covered by an outer facing layer 62 on both sides thereof. A distinguishing feature associated with carton 54 is that padding members 58 extend approximately one-half to two-thirds of the way up the inner side walls of carton 54. As such, the top edges of the padding members 58 form a support ledge 64 which will be described in more detail below. The inner volume 59 defined by the four padding members 58 is dimensioned for receiving a modular seat back 66. As shown, seat back 66 includes a pair of movable handles 68, and a locking bracket 70 for engaging the seat back link 32 of modular wheel chair base 26. Locking bracket 70 also includes a lock-down mechanism 72 for securely locking bracket 70 to seat back link 32 during assembly of the modular chair.

Shipping container 12 also includes a lower pallet 74 and an upper pallet 76, which are each specifically designed with a plurality of cut-outs forming customized compartments. Each cut-out is specifically designed for receiving one of the partially assembled modular components forming the modular chair. Each pallet 74, 76 is similarly dimensioned so that after modular seat back 66 is placed within carton 54, pallets 74, 76 can be placed within carton 54 so that they rest on top of support ledge 64 and modular seat back 66. As disclosed, the outside dimensions of each pallet 74, 76 are approximately 35 inches in length and 29 inches in width.

Pallets 74, 76 are also designed with a unique interlocking feature which helps to prevent movement of one pallet relative to the other. More specifically, several of the modular components contained within lower pallet 74 extend above the top surface of pallet 74. Upper pallet 76 is provided with three through cut-out areas for receiving the upwardly extending portions of these modular components so that upper pallet 76 may be placed directly on top of lower pallet 74 so that they can be packaged in close proximity to each other. The details associated with this interlocking feature are described in more detail below. The packaging within shipping container 12 is completed by placing a top cover 78 onto upper pallet 76 for further protecting the modular components contained within shipping container 12.

As will be appreciated, when all of the modular components are packed within carton 54, shipping container 12 also defines a durable and lightweight shipping apparatus for shipping modular seat back 66 and the remaining preassembled components associated with modular wheel chair base 26. As disclosed, the outside dimensions of carton 54 are approximately 36 inches in length, 30 inches in width, and 16 inches in height, and the weight of shipping container 12 is approximately 60 pounds. Accordingly, these specifications are also within the currently accepted standards for many commercial parcel and overnight delivery services.

Turning now to FIGS. 3 and 4, the details of lower pallet 74 are shown. More specifically, lower pallet 74 includes a plurality of cut-outs 80 for receiving the various modular components associated with the modular chair. FIG. 4 shows lower pallet 74 with the modular components positioned in their designated compartments. As shown, a pair of foot plate cut-outs 84 are provided for receiving foot plates 86. It should be specifically noted that a bracket 88 on each foot plate 86 extends above the top surface of lower pallet 74 for engaging similarly positioned cut-outs 130 on upper pallet 76 and forming the interlocking feature therebetween. A brake assembly cut-out 90 is provided for receiving the pair of brake assemblies 92. It should also be specifically noted that each brake assembly 92 includes a bracket portion 94 which also extends above the surface of lower pallet 74, also for engaging a similarly positioned cut-out 132 on upper pallet 76 and forming the interlocking feature therebetween. Front caster cut-outs 96 are formed in lower pallet 74 for receiving a pair of front casters 98 which are secured to the front portion of wheel chair base 26 during final assembly in the customer's home for example. A pair of front post cut-outs 100 are formed at opposite sides of lower pallet 74 for receiving the front posts 102, which are also secured to modular wheel chair base 26 during final assembly. Finally, a recliner handle cut-out 104 is provided for receiving the recliner handle 106, which is secured along the right side frame of modular wheel chair base 26 on square drive shaft 108.

Preferably, lower pallet 74 is formed from a cardboard honeycomb structure 110 having a paper facing 112, such as heavy duty kraft paper secured thereto. This arrangement provides a structurally rigid yet lightweight packaging material for protecting the modular components associated with the wheeled health care chair during shipping.

It should be noted that the plurality of cut-outs 80 formed within lower pallet 74 each defined a customized outline shape as well as a customized depth within the thickness of lower pallet 74. Additionally, a corrugated pad 81 is laminated to the bottom of pallet 74 to contain modular components within the pallet. As will be appreciated, this feature provides additional protection to the modular components stored within lower pallet 74.

Referring now to FIGS. 5 and 6, the details of upper pallet 76 are shown. Upper pallet 76 is also provided with a plurality of cut-outs 82 which form the individual compartments for receiving the modular components. More particularly, a pair of arm rest cut-outs 114 are provided for receiving arm rests 116. A pair of anti-tip bar cut-outs 118 are provided for receiving anti-tip bars 120. A single rectangular cut-out 122 is formed for receiving the rear axle pins 124, as well as various hardware components and simple hand tools for assembling the modular chair. However, depending on the various options included with the modular chair, rectangular cut-out 122 can also be used for containing other components. A second rectangular cut-out 126 is provided for receiving the pair of foot plate brackets 128 which are secured to the front posts 102 during the final assembly of the modular chair.

A pair of through rectangular cut-outs 130 are provided in the central portion of upper pallet 76 along with a through T-shaped cut-out 132, which also define the interlocking feature associated with lower pallet 74 and upper pallet 76. More specifically, through cut-outs 130 are positioned so that when upper pallet 76 is placed on top of lower pallet 74, the upwardly extending bracket 88 of each foot plate assembly 86 extends up into rectangular cut-out 130. In a similar fashion, T-shaped cut-out 132 is positioned so that bracket portion 94 of the brake assembly 92 will extend up into T-shaped cut-out 132. While the position of cut-outs 130, 132 define the interlocking feature for preventing relative movement between pallets 74, 76, cut-outs 130, 132 also allow for modular components having thicker packaging requirements to be protectively enclosed between two protective pallets 74, 76 in a more compact fashion.

Preferably, upper pallet 76 is also formed from a cardboard honeycomb material 134 which is covered on both sides with a heavy duty kraft paper facing 136. This arrangement provides a structurally rigid yet lightweight packaging material for protecting the modular components associated with the wheeled health care chair during shipping. It should be noted that the plurality of cut-outs 82 formed within upper pallet 76 each define a customized outline shape as well as a customized depth within the thickness of upper pallet 76. Additionally, a corrugated pad 83 is laminated to the bottom of pallet 76 to contain the modular components within the pallet. This feature provides additional protection to the modular components stored within upper pallet 76.

Accordingly, one skilled in the art will readily appreciate that the shipping containers 10, 12 of the present invention provide a lightweight shipping apparatus for transporting the partially assembled components of a modular wheeled health care chair. Additionally, the dimensions and integral design of shipping containers 10, 12 also allow a modular wheeled health care chair to be shipped via a commercial parcel and/or overnight delivery service. Accordingly, the present invention eliminates the previous need for a modular chair such as the wheeled health care chair shown herein to be shipped as freight. This feature represents a considerable time and cost savings to individuals desiring the expedited delivery of a modular chair to their home.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An interlocking pallet assembly for containing an arrangement of components for attachment to a modular wheel chair, said interlocking pallet assembly being disposed within a shipping container and comprising:

a first pallet having a plurality of compartments formed in an upper surface thereof for containing components associated with the modular wheel chair;

a foot plate assembly for the modular wheel chair, the foot plate assembly being disposed within one of the compartments of the first pallet, the foot plate assembly including a vertical member which extends above the upper surface of the first pallet; and a second pallet having a plurality of compartments formed in an upper surface thereof for containing components associated with a base assembly of the modular wheel chair, the second pallet including at least one aperture formed through a bottom surface of the second pallet for receiving the vertical member of the foot plate assembly;

the first and second pallets being similarly dimensioned so that when the second pallet is disposed on the first pallet, the vertical member of the foot plate assembly aligns with and engages the aperture formed in the second pallet thereby forming an interlocking mechanism for preventing movement of the second pallet relative to the first pallet.

2. The pallet assembly of claim 1 wherein the first and second pallets are formed from a reinforced packing material having a honeycomb member disposed between an outer cover material.

3. The pallet assembly of claim 1 wherein the shipping container encloses the first and second pallets, the shipping container defining an inner volume located below the first and second pallets.

4. The pallet assembly of claim 3 wherein the shipping container includes a plurality of inner side walls, each having a padding member associated therewith for defining the inner volume.

5. The pallet assembly of claim 4 wherein each padding member includes a top edge defining a support member for supporting at least the first pallet above the inner volume.

6. A shipping device for containing a modular wheel chair in a partially assembled fashion comprising:

a first carton having closed side walls for containing a partially assembled wheel chair base, the first carton having a bottom member for supporting the wheel chair base;

a pallet member disposed in the first carton for supporting a wheel assembly for the wheel chair base;

a second carton having closed side walls for containing a seat back member, the seat back member being operably associated with the wheel chair base;

a first pallet disposed in the second carton, the first pallet having a plurality of compartments formed in an upper surface thereof for containing at least a foot plate assembly, the foot plate assembly including a vertical member extending above the upper surface of the first pallet; and a second pallet disposed on the first pallet, the second pallet having a plurality of compartments formed in an upper surface thereof for containing components associated with the wheel chair base, the second pallet including an aperture formed through a bottom surface of the second pallet, wherein the aperture is positioned for receiving the vertical member of the foot plate assembly through a lower portion thereof and forming an interlocking mechanism thereby preventing movement of the second pallet relative to the first pallet.

7. The shipping device of claim 6 wherein the first carton includes a cover member disposed on top of the pallet member.

8. The shipping device of claim 6 wherein the second carton includes a cover member disposed on top of the second pallet.

9. The shipping device of claim 6 wherein the second carton includes an inner volume located below the first and second pallets.

10. The shipping device of claim 9 wherein the second carton includes a plurality of inner side walls, each having a peripheral support member associated therewith for defining the inner volume.

11. The shipping device of claim 10 wherein each peripheral support member defines a support ledge along the plurality of inner side walls for supporting at least the first pallet above the inner volume.

12. The shipping device of claim 10 wherein the peripheral support members are formed from a reinforced packing material having a honeycomb member disposed between an outer cover material.

13. The shipping device of claim 6 wherein the first and second compartmentalized pallets are formed from a reinforced packing material having a honeycomb member disposed between an outer cover material.

14. The shipping device of claim 13 wherein the first and second compartmentalized pallets each include a corrugated pad secured to the underside thereof.

15. A shipping apparatus for containing an arrangement of modular components forming a modular wheel chair comprising:

a first carton having four side walls for containing a partially assembled wheel chair base, the first carton having a bottom member for supporting the wheel chair base, the bottom member formed from a lightweight reinforced packing material;

a pallet member disposed on the wheel chair base for supporting a rear wheel assembly for the wheel chair base;

a cover member disposed on top of the pallet member;

a second carton having four side walls for containing a substantially assembled seat back, the second carton having a peripheral support member positioned within a lower section thereof, the seat back including a bracket system for interconnecting with the wheel chair base;

a first pallet disposed in the second carton, the first pallet having a plurality of apertures formed in an upper surface thereof for containing a pair of foot plate assemblies and a brake assembly, the foot plate assemblies and the brake assembly each including a vertical member extending above the upper surface of the first pallet;

a second pallet disposed on the first pallet, the second pallet having a plurality of apertures formed in an upper surface thereof for containing components associated with said wheel chair base, the second pallet including a first pair of apertures and a second aperture formed through a bottom surface of the second pallet, wherein the first and second apertures are positioned for receiving the vertical members of the foot plate assemblies and the brake assembly through a lower portion thereof and forming an interlocking mechanism thereby preventing movement of the second pallet relative to the first pallet; and a cover member disposed on top of the second pallet for protecting the components within the second pallet during shipping.

16. The shipping apparatus of claim 15 wherein the first apertures are rectangular apertures having a predetermined depth for receiving a complimentary shaped bracket member associated with the foot plate assemblies.

17. The shipping apparatus of claim 15 wherein the second aperture is generally a T shaped aperture having a predetermined depth for receiving a complimentary shaped bracket member associated with the brake assembly.

18. The shipping apparatus of claim 15 wherein the second carton includes an inner volume located below the first and second pallets.

19. The shipping apparatus of claim 18 wherein the second carton includes four inner side walls, and the peripheral support member includes a padding member disposed along each inner side wall for defining the inner volume.

20. The shipping apparatus of claim 19 wherein each padding member defines a horizontal support ledge along the inner side walls for supporting at least the first pallet above the inner volume.

* * * * *